US005724792A

United States Patent [19]

Domke et al.

[11] Patent Number: 5,724,792

[45] Date of Patent: Mar. 10, 1998

[54] APPARATUS FOR PRODUCING BAG PACKAGES

[75] Inventors: Klaus Domke, Ditzingen; Joerg Starkmann, Waiblingen; Christoph Lampl, Fellbach; Holger Lachenmaier, Leutenbach; Wolfgang Bischet, Vaihingen; Gerald Keicher, Altbach, all of Germany

[73] Assignee: Robert Bosch GmbH, Stuttgart, Germany

[21] Appl. No.: 737,622

[22] PCT Filed: Mar. 12, 1996

[86] PCT No.: PCT/DE96/00435

§ 371 Date: Jan. 27, 1997

§ 102(e) Date: Jan. 27, 1997

[87] PCT Pub. No.: WO96/29246

PCT Pub. Date: Sep. 26, 1996

[30] Foreign Application Priority Data

Mar. 23, 1995 [DE] Germany ..... 195 10 554.0

[51] Int. Cl.[6] ..... B65B 1/22; B65B 9/20

[52] U.S. Cl. ..... 53/525; 53/526; 53/551

[58] Field of Search ..... 53/525, 529, 530, 53/551, 552, 526

[56] References Cited

U.S. PATENT DOCUMENTS

| | | | |
|---|---|---|---|
| 2,833,091 | 5/1958 | Whitney | 53/525 X |
| 3,153,834 | 10/1964 | Boyer et al. | 53/525 X |
| 3,353,572 | 11/1967 | Anderson et al. | 53/525 X |
| 4,514,959 | 5/1985 | Shroyer | 53/525 X |
| 4,718,217 | 1/1988 | Ross | 53/525 X |
| 4,825,623 | 5/1989 | Ross | 53/525 X |
| 4,827,697 | 5/1989 | Ross | 53/525 X |
| 5,125,213 | 6/1992 | Focke et al. | 53/525 X |
| 5,473,866 | 12/1995 | Maglecic et al. | 53/552 X |
| 5,505,040 | 4/1996 | Janssen et al. | 53/551 X |

*Primary Examiner*—Horace M. Culver

*Attorney, Agent, or Firm*—Edwin E. Greigg; Ronald E. Greigg

[57] ABSTRACT

An apparatus for producing bag packages which includes an oscillation generator, a bearing frame which transmits oscillations in the longitudinal and/or crosswise direction to a forming pipe. The forming pipe and a forming shoulder of the apparatus are rigidly joined to one another. A longitudinal seam sealing device is also joined to the bearing frame. The oscillations serve the purpose of both low-friction transport of a tube via the forming shoulder and the forming pipe and of compacting the product.

20 Claims, 3 Drawing Sheets

APPARATUS FOR PRODUCING BAG PACKAGES

PRIOR ART

The invention is based on an apparatus for producing bag packages. To reduce the friction between the packaging material and the forming shoulder, it is known from German Patent Disclosure DE 34 11 370 A1 to cause the forming shoulder to oscillate. A disadvantage of this is that relative motions occur in the transition region between the forming shoulder and the forming pipe, which stress the tube during its stopped phase, for instance during the crosswise sealing. It is also known from German Published, Unexamined Patent Disclosure DE-OS 24 50 008 to cause merely the forming pipe to oscillate longitudinally, but to leave the forming shoulder stationary. This not only reduces the friction between the packaging material and the forming pipe but also shakes loose any product sticking to the inside of the forming pipe. The problems with respect to relative motion between the forming pipe and the forming shoulder, however, exist in this known apparatus as well. Moreover, product is fed loosely into the tube, in other words uncompacted, so that the consumption of packaging material is relatively high in this known apparatus.

ADVANTAGES OF THE INVENTION

The apparatus according to the invention for producing bag packages has the advantage over the prior art that no relative motions occur in the transitional region between the forming shoulder and the forming pipe. As a result, the strain on the tube is reduced, and even untreated foil or film materials with relatively poor coefficients of friction can be used. Compacting of the product in the tube is also attained, thereby lowering the consumption of packaging material. In addition, the adhesion of product to the end of the filling pipe is avoided, so that particularly when the crosswise seam is formed the danger that the crosswise seam will be soiled is reduced.

Further advantages and advantageous features of the apparatus according to the invention for producing bag packages will become apparent from the description. In a first embodiment of the invention, it is possible to transmit merely longitudinal oscillation to the tube forming device. As a result, in particular fine-particle product is strongly compacted. In a second embodiment of the invention, in additional to the longitudinal oscillations, crosswise oscillations are also generated and transmitted to the tube. This allows a high degree of compaction, especially with a product that has a tendency to become caught. It is especially advantageous if the proportion of crosswise oscillation components, in the second embodiment of the invention, can be varied in accordance with the product. Optimal compaction adapted to the product is thereby possible.

BRIEF DESCRIPTION OF THE DRAWING

Two exemplary embodiments of the invention are shown in the drawings and will be described in further detail in the ensuing description.

DESCRIPTION OF THE EXEMPLARY EMBODIMENTS

Figure 1:
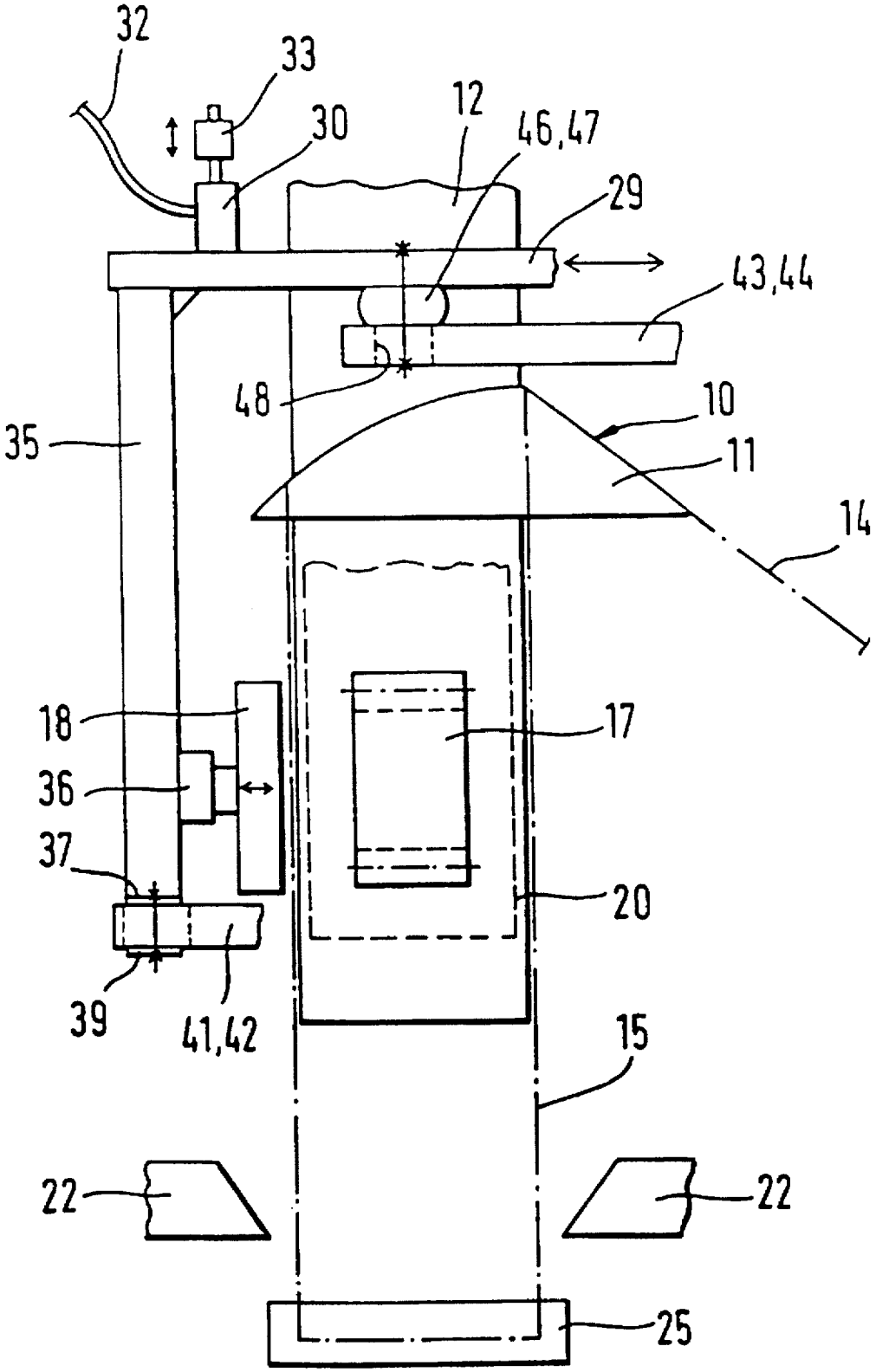
FIG. 1 shows a first apparatus for producing bag packages, in a simplified side view.
Figure 2:
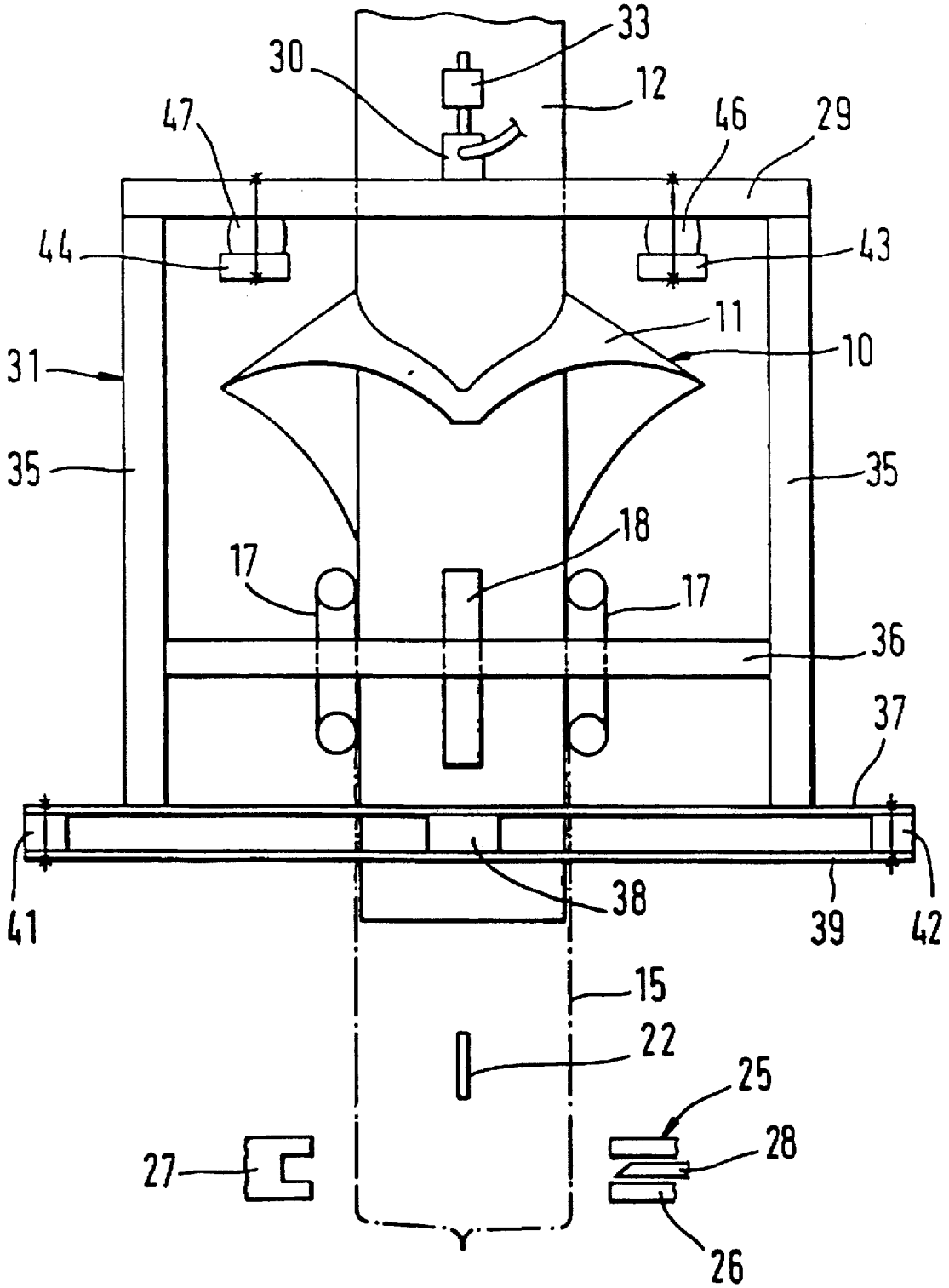
FIG. 2 shows the apparatus of FIG. 1 in a simplified front view.

The first apparatus for producing bag packages, shown in FIGS. 1 and 2, has a tube forming device 10, comprising a forming shoulder 11 and a forming pipe 12 rigidly joined to the forming shoulder 11. By means of the tube forming device 10, a tube 15 is shaped from a strip of packaging material 14 that can be hot sealed on at least one side. The strip of packaging material 14 is kept on hand on a supply roll, not shown, and is transported or drawn off in increments by means of two vacuum-supported conveyor belts 17 disposed opposite the forming pipe 12.

To form a continuous longitudinal seam, a longitudinal seam sealing device 18 is disposed between the conveyor belts 17 on the forming pipe 12. The longitudinal seam sealing device 18 is movable horizontally back and forth in the direction of the forming pipe 12. Inside the forming pipe 12, a fill pipe 20, drawn in dashed lines in FIG. 1, is provided for feeding solid products of fine-particle consistency into the end of the tube, examples being flour, spices or the like. The sealing pipe 20 ends above the end of the forming pipe. Located below the forming pipe 12 is a folder device 22 for the bottom of the bag packages and a combined crosswise seam sealing and cutting device 25. This device has two sealing jaws 26, 27, shown in FIG. 2, and a cutting knife 28 in order to simultaneously form a top or a bottom seam and to cut finished bags apart from the tube 15. The folder device 22 and the crosswise seam sealing and cutting device 25 are connected to the frame, not shown, of the apparatus.

The apparatus is especially arranged for compacting the product and for low-friction transport of the strip of packaging material 14. To that end, the forming pipe 12 is solidly joined to the base plate 29 of a bearing frame 31. An oscillation generator 30 is secured to the base plate 29.

The oscillation generator 30 is supplied with compressed air, for instance by means of a line 32, which serves to move an exciter mask 33 up and down. The motion of the exciter mask 33 in the longitudinal direction of the forming pipe 12 generates oscillation in the desired way. Two beams 35, joined together by a crossbar 36, extend from the base plate 29 in longitudinal alignment with the forming pipe 12. The longitudinal seam sealing device 18 is also secured to the crossbar 36. A first leaf spring 37 is disposed on the lower end of the beam 35, parallel to the crossbar 36. The leaf spring 37 is joined via an intermediate block 38 to a second leaf spring 39. The alignment of the two leaf springs 37, 39 is such that they yield along with the beam 35 only upon longitudinal motions of the beam, but do not allow any crosswise motions of the beam 35. To that end, the leaf springs 37, 39 are rigidly secured to two struts 41, 42 of the apparatus frame; these struts 41, 42 are symmetrical with the intermediate block 38 and fit positively between the two leaf springs 37, 39.

Two further struts 43, 44 of the bearing frame 31 of the first apparatus are disposed on both sides of the forming pipe 12 above the forming shoulder 11. The struts 43, 44 are joined to the base plate 29 with the interposition of two elastic damping bodies 46, 47, which are preferably embodied as rubber bearings. To avoid possible tilting moments with reference to the damping bodies 46, 47, the base plate 29 is disposed so as to be displaceable crosswise to the forming pipe 12. To that end, oblong slots 48 are formed, for instance in the struts 43, 44, so that the base plate 29 is displaceable within certain limits. It is advantageous for the composite construction comprising the base plate 29 with the oscillation generator 30, beam 35 and crossbar 36, and leaf springs 37, 39 to be statically balanced. This means that no forces of gravity of the aforementioned composite weight down the two leaf springs 37, 39. As a result, relatively soft, supply leaf springs 37, 39 can be used, so that longitudinal oscillations—caused by the oscillation generator 30—are only very weakly damped by the leaf springs 37, 39. The result of this is that the longitudinal oscillations are transmitted virtually undamped to the tube forming device 10, and in particular to the forming pipe 12.

The above-described first apparatus for producing bag packages functions as follows:

To reduce the friction between the strip of packaging material 14 or the tube 15 and the tube forming device 10, the tube forming device 10 is made to oscillate by the oscillation generator 30. The inducement is such that the forming pipe 12 oscillates only in the longitudinal direction, or in other words in the feeding direction of the tube 15. To suppress transverse oscillation, that is, transverse waves originating at the oscillation generator 30, the beams 35 are solidly joined in the transverse direction of the forming pipe 12 by means of the leaf springs 37, 39. Because of the disposition of the leaf springs 37, 39, the beams 35 and the longitudinal seam sealing device 18 oscillate at the same frequency as the tube forming device 10.

Two criteria are definitive for the choice of the excitement frequency by the oscillation generator 30: first, the frequency should be as high as possible, so that the largest possible relative accelerations prevail between the strip of packaging material 14 and the tube forming device 10. This means that for the friction, it is no longer the factor of static friction but rather the sliding friction factor that is operative. On the other, if the vacuum-reinforced conveyor belts 17 are not feeding any tube 15, the vibration of the oscillation generator 30 should be transmitted to the tube 15, so that the product will be compacted as desired. However, that requires that static friction always prevail between the tube forming device 10, and in particular the forming pipe 12, and the tube 15; in other words, the exciter frequency is relatively low. In order to still attain compacting of the product even at relatively high exciter frequencies, the longitudinal seam sealing device 18 is rigidly joined to the base plate 29 by means of the crossbar 26 and the beams 35. Thus the longitudinal seam sealing device 18 likewise oscillates at the frequency of the oscillation generator 30. This has the advantage that the longitudinal seam sealing device 18, in the stopped phase of the tube 15 during the formation of the longitudinal seam, is pressed against the forming pipe 12, so that the tube 15 is clamped between the forming pipe 12, which oscillates at the exciter frequency, and the longitudinal seam sealing device 18. Because of this clamping, even relatively high exciter frequencies can still be transmitted to the tube 15, which would otherwise cause the tube 15 to slide on the tube forming device 10. This is especially advantageous if, given high performance of the apparatus or in other words when only relatively little time is available to fill the tube 15, a plurality of compacting oscillation must be transmitted to the end of the tube in order to compact the product, or in other words if the exciter frequency has to be relatively high. In practice, depending on the material used for the strip of packaging material 14, exciter frequencies of approximately 10 to 20 Hz have proven to be favorable.

It will be noted in addition that instead of one oscillation generator 30, a plurality of oscillation generators may also be used, which are all secured for instance to the base plate 29. As a result, a first oscillation generator, for instance, can excite the tube forming device 10 by means of an optimal (high) feeding frequency during the feeding of the tube 15, while in the filling phase a second oscillation generator excites the tube 15 by means of an optimal (low) compacting frequency. During the respective operating phase of the apparatus, only one oscillation generator is then active at a time.

The same effect can also be attained, however, if only one oscillation generator, with an adjustable oscillation frequency, is used, or two or more oscillation generators, whose oscillation frequencies or oscillation amplitudes are superimposed on one another; depending on the operating state, one or the other oscillation generator is then purposefully turned on or off.

In contrast to the exemplary embodiment, it is also possible, for transporting the tube 15, to use instead of the vacuum-reinforced conveyor belts 17, crosswise seam sealing jaws that are movable up and down, which in a known manner feed the tube 15 during a downward motion. The balancing out of the base plate 29 with respect to the damping bodies 46, 47 is accomplished in this exemplary embodiment by displacement in the oblong slots 48 of the struts 43, 44. However, it is also conceivable to attain this by means of suitably large compensating weights on the base plate 29.

Figure 3:
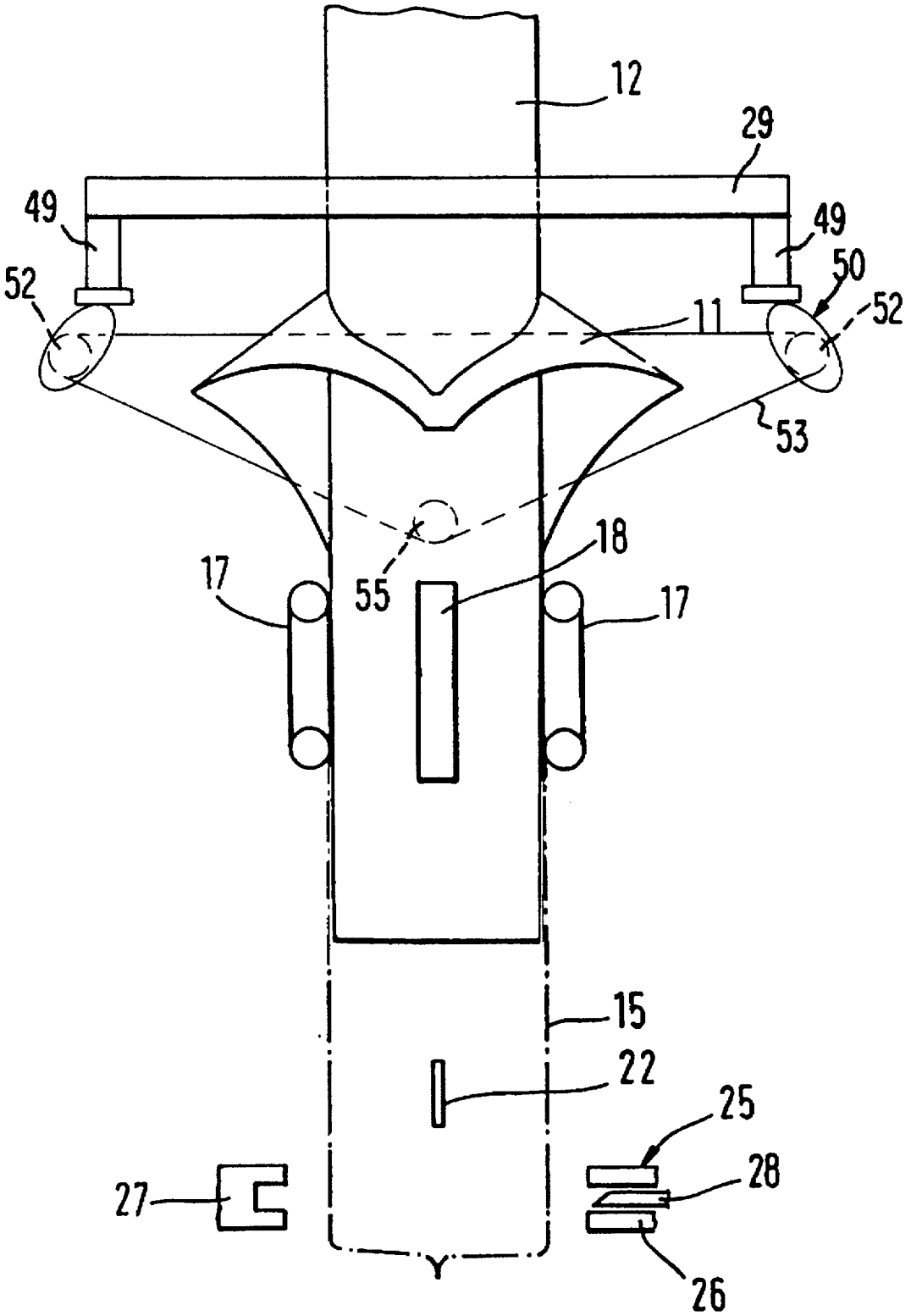
FIG. 3 shows a second apparatus for producing bag packages, in a simplified front view.

In the second embodiment of the apparatus, shown in FIG. 3, the forming pipe 12 is likewise joined to a base plate 29. The base plate 29 is joined on both sides of the forming pipe 12 to at least one tappet 49 on each side. The tappets 49 are operatively connected to an oscillation generator 50, which is embodied in the form of two camshafts 52 with cams. The camshafts 52 supported in the frame 31 of the apparatus are coupled by means of a common toothed belt 53, which is turn is driven by a motor 55. The angular position of each of the two camshafts 52 is variable independently of the position of the respectively other camshaft 52. Thus depending on the position of the two camshafts 52 to one another, not only longitudinal oscillations but also crosswise or horizontal oscillations can be transmitted. For certain products, such as a product that tends to become caught, this can be advantageous, since higher degrees of compaction can thus be attained. Because of the adjustability of the camshafts 52, it is possible to vary the proportion of horizontal oscillations in order to attain optimal adaptation to the particular product.

It will be noted in addition, that instead of the toothed belt 53 in the motor 55, a separate drive may be provided for each of the two camshafts 52. This makes for easier adjustability of the respective camshaft position.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for producing bag packages, having a forming shoulder (11) and a forming pipe (12) for forming a tube (15) of a strip of packaging material (14) that can be heat-sealed on at least one side, comprising a device (17) for feeding the tube (15) a longitudinal seam sealing device (18) and a crosswise seam sealing and cutting device (25), and a filling pipe (20) for feeding a product into an end of the tube, the forming shoulder (11), the forming pipe (12) and the longitudinal seam sealing device (18) are rigidly joined to one another and are operatively connected by means of an oscillation generator (30, 50).

2. The apparatus according to claim 1, in which the oscillation generator (30) generates solely an oscillation in a longitudinal direction of the forming pipe (12).

3. The apparatus according to claim 1, in which the oscillation generator (30) is disposed on a bearing frame (31), and that the bearing frame (31) has at least one spring element (37, 39), which is movable solely in a longitudinal direction of the forming pipe (12).

4. The apparatus according to claim 2, in which the oscillation generator (30) is disposed on a bearing frame (31), and that the bearing frame (31) has at least one spring element (37, 39), which is movable solely in a longitudinal direction of the forming pipe (12).

5. The apparatus according to claim 3, in which the bearing frame (31) is embodied as adjustable for the sake of balancing.

6. The apparatus according to claim 4, in which the bearing frame (31) is embodied as adjustable for the sake of balancing.

7. The apparatus according to claim 1, characterized in that the oscillation generator (30) is pneumatically driven.

8. The apparatus according to claim 2, characterized in that the oscillation generator (30) is pneumatically driven.

9. The apparatus according to claim 3, characterized in that the oscillation generator (30) is pneumatically driven.

10. The apparatus according to claim 5, characterized in that the oscillation generator (30) is pneumatically driven.

11. The apparatus according to claim 1, in which the oscillation generator (30) is coupled to the apparatus by means of at least one damping body (46, 47).

12. The apparatus according to claim 2, in which the oscillation generator (30) is coupled to the apparatus by means of at least one damping body (46, 47).

13. The apparatus according to claim 3, in which the oscillation generator (30) is coupled to the apparatus by means of at least one damping body (46, 47).

14. The apparatus according to claim 5, in which the oscillation generator (30) is coupled to the apparatus by means of at least one damping body (46, 47).

15. The apparatus according to claim 7, in which the oscillation generator (30) is coupled to the apparatus by means of at least one damping body (46, 47).

16. The apparatus according to claim 1, in which the oscillation generator (50) generates both oscillations in the longitudinal direction of the forming pipe (12) and oscillations in the transverse direction thereof.

17. The apparatus according to claim 16, in which the oscillation generator has at least two elements (52) with cams, which elements are joined to the forming pipe (12) by means of transmission elements (29, 49).

18. The apparatus according to claim 17, characterized in that the position of the two elements (52) that have cams is adjustable relative to one another.

19. The apparatus according to claim 17, characterized in that the elements (52) having cams are coupled to one another by means of a common toothed belt (53).

20. The apparatus according to claim 18, characterized in that the elements (52) having cams are coupled to one another by means of a common toothed belt (53).

* * * * *